US010601155B2

(12) United States Patent
Werz

(10) Patent No.: US 10,601,155 B2
(45) Date of Patent: Mar. 24, 2020

(54) CONTACTING DEVICE FOR THE TRANSMISSION OF ELECTRICAL ENERGY TO A CIRCUIT BOARD AND METHOD FOR THE ASSEMBLY OF SUCH A CONTACTING DEVICE

(71) Applicant: Würth Elektronik eiSos GmbH & Co. KG, Waldenburg (DE)

(72) Inventor: Wladimir Werz, Schwäbisch Hall (DE)

(73) Assignee: WÜRTH ELEKTRONIK EISOS GMBH & CO. KG, Waldenburg (DE)

( * ) Notice: Subject to any disclaimer, the term of this patent is extended or adjusted under 35 U.S.C. 154(b) by 0 days.

(21) Appl. No.: 16/302,353

(22) PCT Filed: May 17, 2017

(86) PCT No.: PCT/EP2017/061867
§ 371 (c)(1),
(2) Date: Nov. 16, 2018

(87) PCT Pub. No.: WO2017/198728
PCT Pub. Date: Nov. 23, 2017

(65) Prior Publication Data

US 2019/0296461 A1 Sep. 26, 2019

(30) Foreign Application Priority Data

May 19, 2016 (DE) ..... 20 2016 102 669 U

(51) Int. Cl.
*H01R 12/53* (2011.01)
*H01R 12/58* (2011.01)
(Continued)

(52) U.S. Cl.
CPC ..... *H01R 12/53* (2013.01); *H01R 4/183* (2013.01); *H01R 4/4872* (2013.01); *H01R 11/11* (2013.01);
(Continued)

(58) Field of Classification Search
CPC .. H01R 12/7088; H01R 12/58; H01R 12/585; H01R 12/728; H01R 13/111;
(Continued)

(56) References Cited

U.S. PATENT DOCUMENTS 3,221,291 A * 11/1965 Pratt ..... H01R 9/2491 439/733.1
4,749,357 A 6/1988 Foley
(Continued)

FOREIGN PATENT DOCUMENTS

DE 10 36 969 B 8/1985
GB 592 135 A 9/1947

*Primary Examiner* — Edwin A. Leon
*Assistant Examiner* — Matthew T Dzierzynski
(74) *Attorney, Agent, or Firm* — McGlew and Tuttle, P.C.

(57) ABSTRACT

A contacting device has a housing in which a first contact element is arranged. The first contact element has a receiving chamber for a second contact element, which is open with respect to at least one opening of the housing. The first contact element is displaceable relative to the housing in a direction transverse to a central longitudinal axis of the receiving chamber against a spring element, so that the second contact element is insertable into the receiving chamber and capable of being clamped in the receiving chamber by the spring element. The first contact element is firmly connected to at least one plug-in contact element. By this device, a transmission of electrical energy from a power supply line to a circuit board can be achieved in simple and reliable manner.

20 Claims, 9 Drawing Sheets

(51) Int. Cl.

| | |
|---|---|
| ***H01R 12/71*** | (2011.01) |
| ***H01R 4/48*** | (2006.01) |
| ***H01R 4/18*** | (2006.01) |
| ***H01R 11/11*** | (2006.01) |
| ***H01R 13/506*** | (2006.01) |
| ***H01R 43/26*** | (2006.01) |
| *H01R 13/20* | (2006.01) |

(52) U.S. Cl.
CPC ..... *H01R 12/58* (2013.01); *H01R 12/71* (2013.01); *H01R 13/506* (2013.01); *H01R 43/26* (2013.01); *H01R 13/20* (2013.01)

(58) Field of Classification Search
CPC ..... H01R 25/162; H01R 12/7052; H01R 12/7064; H01R 12/707; H01R 12/71; H01R 12/712; H01R 12/716; H01R 12/718; H01R 12/91; H01R 13/187; H01R 13/53; H01R 13/533; H01R 13/6315; H01R 4/2433; H01R 4/304
See application file for complete search history.

(56) References Cited

U.S. PATENT DOCUMENTS

| | | | | | |
|---|---|---|---|---|---|
| 5,055,055 | A * | 10/1991 | Bakker | H01R 13/6315 | 29/883 |
| 5,807,120 | A * | 9/1998 | Matthews | H01R 12/58 | 439/748 |
| D435,015 | S * | 12/2000 | Wang | D13/133 | |
| 6,280,245 | B1 * | 8/2001 | Han | H01R 13/514 | 439/541.5 |
| 6,319,021 | B1 * | 11/2001 | Billman | H01R 12/585 | 439/78 |
| 6,431,891 | B1 * | 8/2002 | Billman | H01R 24/58 | 439/176 |
| 6,461,174 | B1 * | 10/2002 | Hwang | H01R 12/585 | 439/78 |
| 7,422,459 | B2 * | 9/2008 | Hopper | G01K 1/14 | 374/E1.018 |
| 9,379,468 | B2 * | 6/2016 | Zieman | H01R 12/91 | |
| 10,312,612 | B2 * | 6/2019 | Ho | H01R 12/7052 | |
| 2018/0337463 | A1 * | 11/2018 | Washio | H01R 4/24 | |

* cited by examiner

CONTACTING DEVICE FOR THE TRANSMISSION OF ELECTRICAL ENERGY TO A CIRCUIT BOARD AND METHOD FOR THE ASSEMBLY OF SUCH A CONTACTING DEVICE

CROSS REFERENCE TO RELATED APPLICATIONS

This application is a United States National Phase Application of International Application PCT/EP2017/061867 filed May 17, 2017 and claims the benefit of priority under 35 U.S.C. § 119 of German Utility Model Application Serial No. DE 20 2016 102 669.5 filed May 19, 2016, the entire contents of which are incorporated herein by reference.

FIELD OF THE INVENTION

The invention relates to a contacting device for transmitting electrical energy to a circuit board. The invention further relates to a method for assembling a contacting device.

BACKGROUND OF THE INVENTION

A contacting device for contacting a power supply line with a circuit board is known from U.S. Pat. No. 4,749,357 A. The contacting device exhibits a thermoplastic body, on which a conductive bus element is arranged. The bus element is connected in conducting manner to several contact pins which extend through the thermoplastic body. The contact pins are capable of being plugged into recesses of the circuit board, and of being contacted with the circuit board. A conductive socket which is connected to the bus element and accessible through an opening is arranged in the thermoplastic body. A contact pin which is connected to the power supply line is insertable into the socket. The contact pin is held frictionally in the socket by means of a contact spring.

SUMMARY OF THE INVENTION

An object underlying the invention is to create a simply constructed and easy-to-assemble contacting device which enables a transmission of electrical energy to a circuit board in simple and reliable manner with a low resistance.

This object is achieved by a contacting device for transmitting electrical energy to a circuit board, with a housing which has at least one opening, a first contact element, which is arranged in the housing and which has a receiving chamber which is open with respect to the at least one opening, with a central longitudinal axis, at least one plug-in contact element for mechanical and electrical connecting of the first contact element to a circuit board, a second contact element for insertion into the receiving chamber through the at least one opening and for contacting the first contact element, wherein the housing and the first contact element are displaceable relative to one another in a direction transverse to the central longitudinal axis, wherein a spring element acting in a direction transverse to the central longitudinal axis is arranged between the housing and the first contact element, wherein the at least one plug-in contact element and the first contact element are firmly connected to one another. The housing and the first contact element are displaceable relative to one another in a direction transverse to the central longitudinal axis of the receiving chamber. The spring element acts between the housing and the first contact element in a direction transverse to the central longitudinal axis and is biased. In an insertion position, the first contact element has been displaced relative to the housing by an external force against the spring force of the spring element in such a manner that the second contact element is insertable into the receiving chamber of the first contact element through the at least one opening of the housing. Once the second contact element has been arranged in the receiving chamber, the first contact element is capable of being transferred relative to the housing in simple manner by relaxation of the spring element into a clamping position. In the clamping position, the second contact element has been contacted with the first contact element in simple and reliable manner between the first contact element and the housing by reason of the spring force of the spring element acting in a direction transverse to the central longitudinal axis. By virtue of the spring force of the spring element and the contact surface between the first contact element and the second contact element, an electrical connection with a low electrical resistance is guaranteed. By virtue of the fact that the at least one plug-in contact element and the first contact element are firmly connected to one another and not displaceable relative to one another in a direction transverse to the central longitudinal axis, a transmission of electrical energy from the first contact element to a circuit board with a low electrical resistance is possible in simple and reliable manner. By virtue of the firm connection, in addition the contacting device is stable and easy to assemble. The number of components of the contacting device is comparatively small, so the contacting device is simply constructed and can be produced inexpensively. The housing has preferentially been formed from an electrically insulating material, in particular a synthetic material. On the other hand, the contact elements and the at least one plug-in contact element are made of at least one conductive material. The at least one plug-in contact element takes the form, in particular, of a pin and/or a bore or recess. The at least one plug-in contact element has, in particular, a thread.

A contacting device configured such that the first contact element and the at least one plug-in contact element are formed in one piece guarantees a simple structure and also a reliable transmission of electrical energy to a circuit board with a low electrical resistance. By virtue of the one-piece design, the first contact element and the at least one plug-in contact element are connected to one another in stable and effectively conductive manner. The number of components is small by virtue of the one-piece design, and the production and preassembly of the contacting device are simple and inexpensive.

A contacting device configured such that the housing forms a first stop for limiting the motion of the first contact element in a first displacement direction and a second stop for limiting the motion of the first contact element in a contrary second displacement direction guarantees a simple structure and a simple assembly. By virtue of the first stop, it is guaranteed that the relative motion of the housing and of the first contact element in an insertion position is limited, so that in the insertion position the second contact element is insertable into the receiving chamber through the at least one opening. By virtue of the second stop, it is guaranteed that a relative motion of the housing and of the first contact element as a consequence of the spring force of the spring element is limited if the second contact element is not located in the receiving chamber and has been clamped between the housing and the first contact element.

A contacting device configured such that the housing has a passage opening for the first contact element guarantees a simple structure and a simple assembly. By virtue of the fact that the first contact element extends through the passage opening and is intermittently exposed, a simple contacting with the circuit board is possible by means of the at least one plug-in contact element. In addition, the first contact element is guided securely in the housing in the event of relative motions, so that requisite relative motions between the housing and the first contact element for the purpose of assembling the contacting device are possible simply and reliably.

A contacting device configured such that the housing comprises two housing parts, which, in particular, form a latching connection, guarantees a simple structure and a simple assembly. The first contact element and the spring element are arranged in an interior space delimited by the two housing parts, and the housing parts are subsequently connected to one another. The housing parts preferentially form a latching connection. For this purpose, latching projections which engage in associated latching openings of the respective other housing part have been formed on at least one of the housing parts. The housing parts have preferentially been formed from a synthetic material. For the purpose of enhancing the flexibility, at least one of the housing parts exhibits slots, for instance, which in the region of the latching connection increase the freedom of motion of the latching projections and/or of the latching openings.

A contacting device configured such that a plurality of plug-in contact elements for distributing energy are firmly connected to the first contact element guarantees in simple manner a transmission of electrical energy to a circuit board and a distribution of energy on the circuit board. Furthermore, a reliable mechanical connection of the plug-in contact elements to the circuit board and a high electrical conductivity are guaranteed.

A contacting device configured such that the second contact element has a cylindrical contact portion, and the receiving chamber for receiving and clamping the contact portion is of cylindrical design guarantees in simple manner a transmission of electrical energy from the second contact element to the first contact element with a low electrical resistance. By virtue of the cylindrical contact portion and the cylindrically formed receiving chamber, a large contact surface and a low contact resistance are achieved. A length of the contact portion in the direction of the central longitudinal axis preferentially corresponds to a length of the receiving chamber. A diameter of the contact portion in proportion to a diameter of the receiving chamber is such that the contact portion is insertable into the receiving chamber and has as little radial play as possible there.

A contacting device configured such that the second contact element has at least one groove, and the housing forms a wall, delimiting the at least one opening, for engagement in the at least one groove enables a transmission of electrical energy in simple and reliable manner. By virtue of the at least one groove and the associated wall of the housing, the second contact element is securely clamped in the receiving chamber and secured against a displacement in the direction of the central longitudinal axis. The at least one groove preferentially takes the form of a circumferential annular groove. The at least one groove preferentially has a cross-section tapering in the direction of a groove bottom. By this means, the second contact element is oriented in the direction of the central longitudinal axis in the course of clamping relative to the first contact element. This makes possible an optimal contact surface between the first contact element and the second contact element in simple and reliable manner. The second contact element preferentially exhibits two grooves which have been formed on both sides of a contact portion. Accordingly, the housing exhibits two openings, situated opposite one another, for guiding the second contact element through, so that the wall delimiting the respective opening engages in the associated groove in a clamping state of the second contact element.

A contacting device configured such that the housing has two openings situated opposite one another for passing through the second contact element guarantees a simple and reliable assembly. By virtue of the two openings situated opposite one another, the second contact element is insertable into the receiving chamber from different sides. By this means, a simple and flexible assembly is guaranteed. Moreover, the second contact element is capable of being guided through the two opposing openings, so that the second contact element is capable of being secured in simple manner against displacement in the direction of the central longitudinal axis by means of two grooves and a wall of the housing delimiting the respective opening.

A contacting device configured such that the second contact element has a stop for limiting the inserting into the housing guarantees a simple assembly. The stop preferentially takes the form of an annular stop.

A contacting device configured such that the second contact element has a tapering tip for inserting into the housing guarantees a simple assembly. By virtue of the tapering tip, the second contact element is insertable into the receiving chamber in simple manner through the at least one opening.

A contacting device configured such that the second contact element has a crimp portion for connecting to a power supply line guarantees in simple and reliable manner a transmission of electrical energy with a low electrical resistance. By means of the crimp portion, the second contact element is capable of being contacted with a power supply line simply and reliably and with a low ohmic resistance. The second contact element has been formed from brass, for instance, and the crimp portion has been soft-annealed.

An object further underlying the invention is to create a method for assembling a contacting device that enables, in simple and reliable manner, a transmission of electrical energy to a circuit board with a low resistance.

This object is achieved by a method for assembling a contacting device, the method comprising the steps of providing a preassembled subunit comprising a housing which has at least one opening, a first contact element which is arranged in the housing and which has a receiving chamber which is open with respect to the at least one opening, with a central longitudinal axis, said housing and said first contact element being displaceable to one another in a direction transverse to the central longitudinal axis, a spring element acting in a direction transverse to the central longitudinal axis, which is arranged between the housing and the first contact element, at least one plug-in contact element for mechanical and electrical connecting of the first contact element to a circuit board, said at least one plug-in contact element and said first contact element being firmly connected to one another, contacting the first contact element with the circuit board by inserting the at least one plug-in contact element into an associated plug-in contact element receptacle of the circuit board, displacing the housing and the first contact element relative to one another in a direction transverse to the central longitudinal axis against a spring force of the spring element into an insertion position, inserting a second contact element into the receiving chamber through the at least one opening, displacing the housing and the first contact element relative to one another in a direction transverse to the central longitudinal axis by relaxation of the spring element into a clamping position, clamping the second contact element located in the receiving chamber between the housing and the first contact element in such a manner that the second contact element is contacted with the circuit board in electrically conducting manner via the first contact element and the at least one plug-in contact element. The advantages of the method according to the invention correspond to the already described advantages of the contacting device according to the invention.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
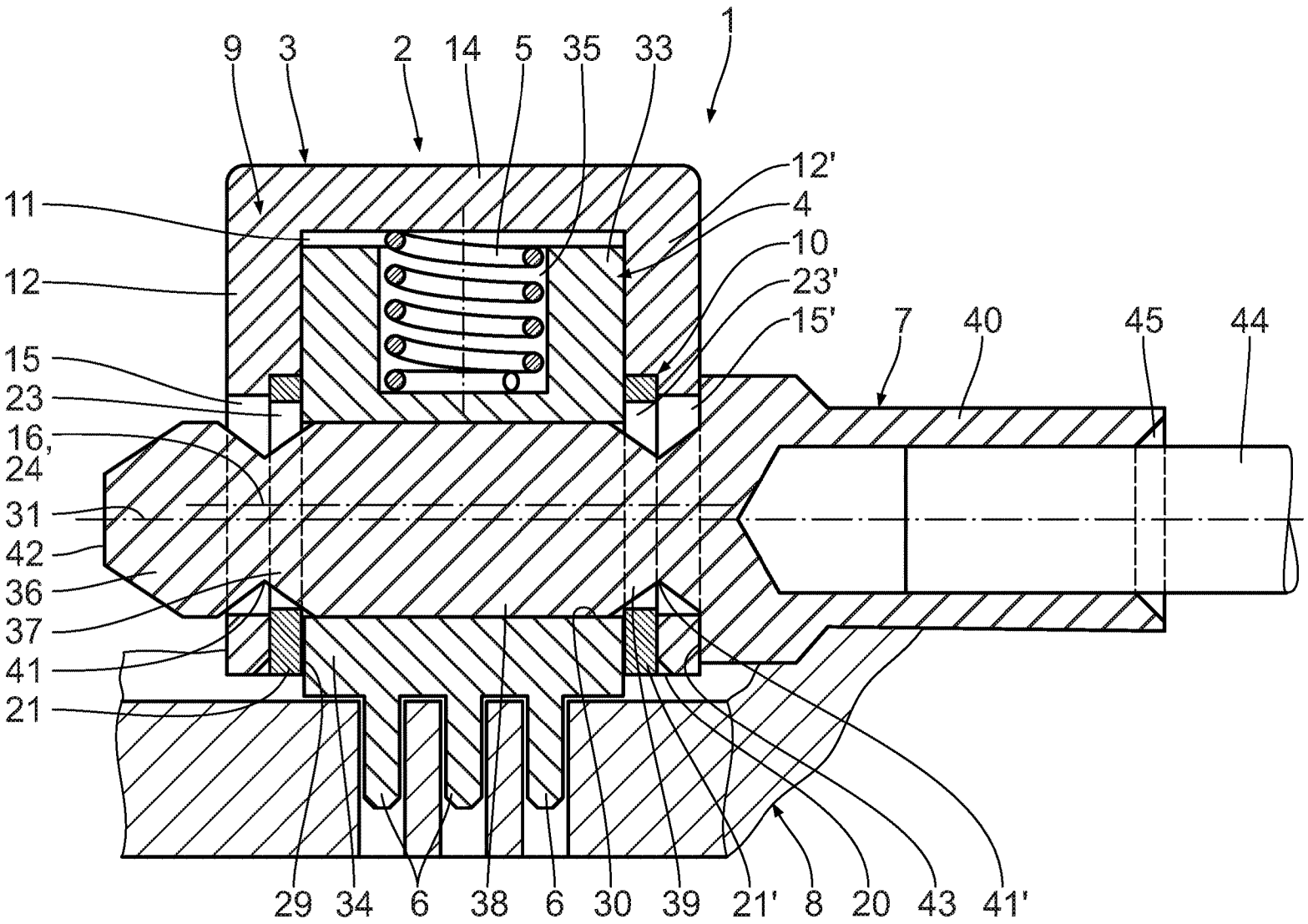
FIG. 1 is a first sectional view of a contacting device for transmitting electrical energy from a power supply line to a circuit board, according to a first embodiment.
Figure 2:
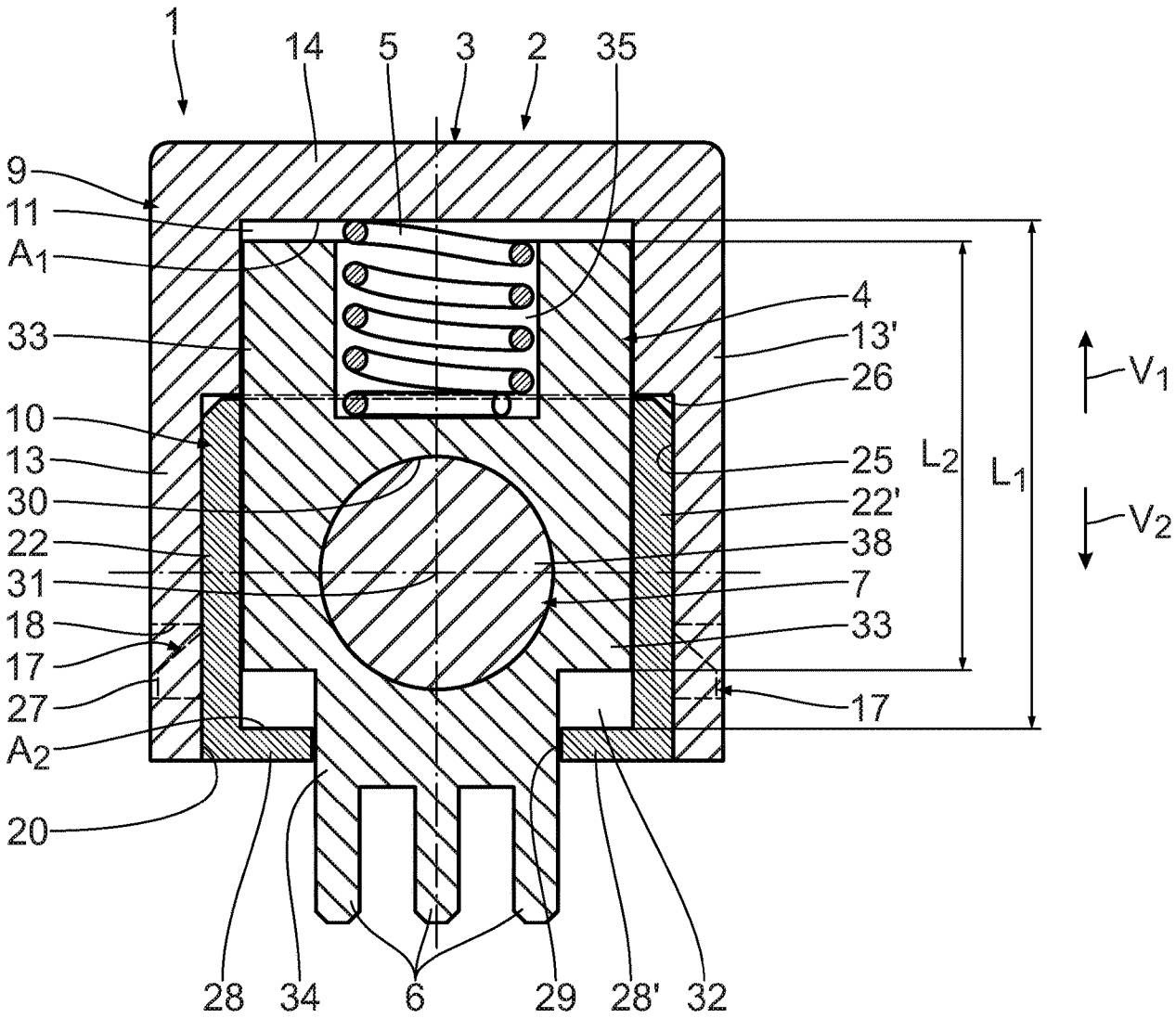
FIG. 2 is a second sectional view of the contacting device, perpendicular to the sectional view in FIG. 1.
Figure 3:
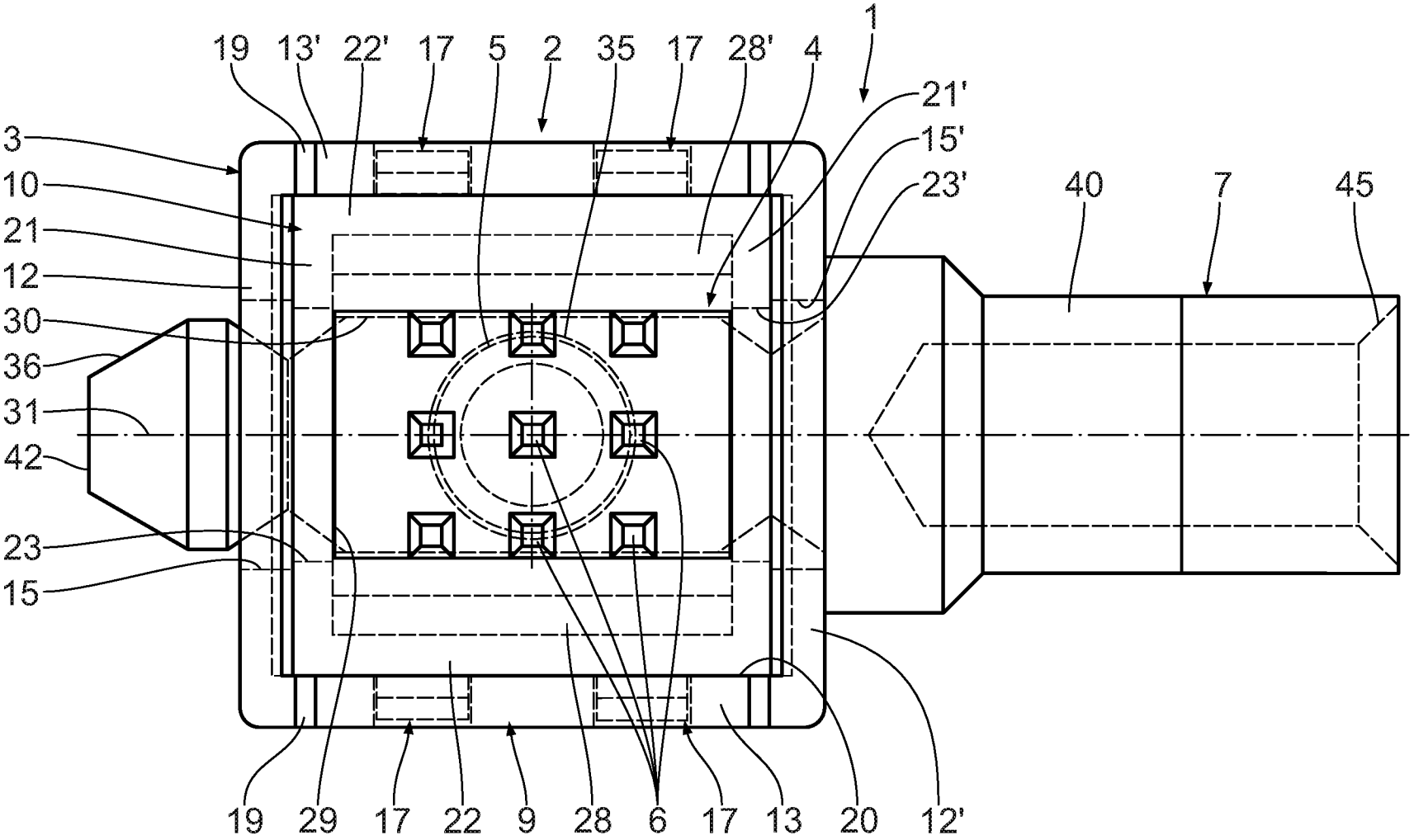
FIG. 3 is a plan view of an underside of the contacting device.
Figure 4:
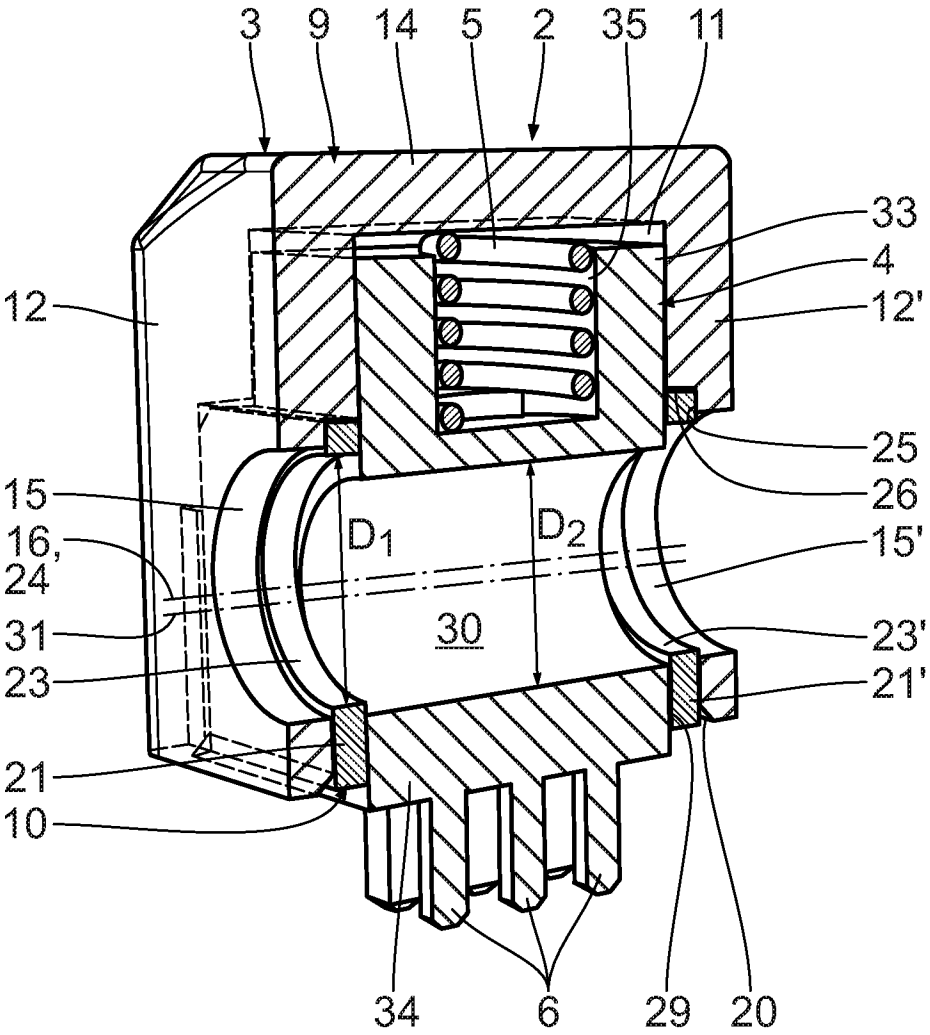
FIG. 4 is a sectional view of a preassembled subunit of the contacting device in FIG. 1 without an inserted contact element.
Figure 5:
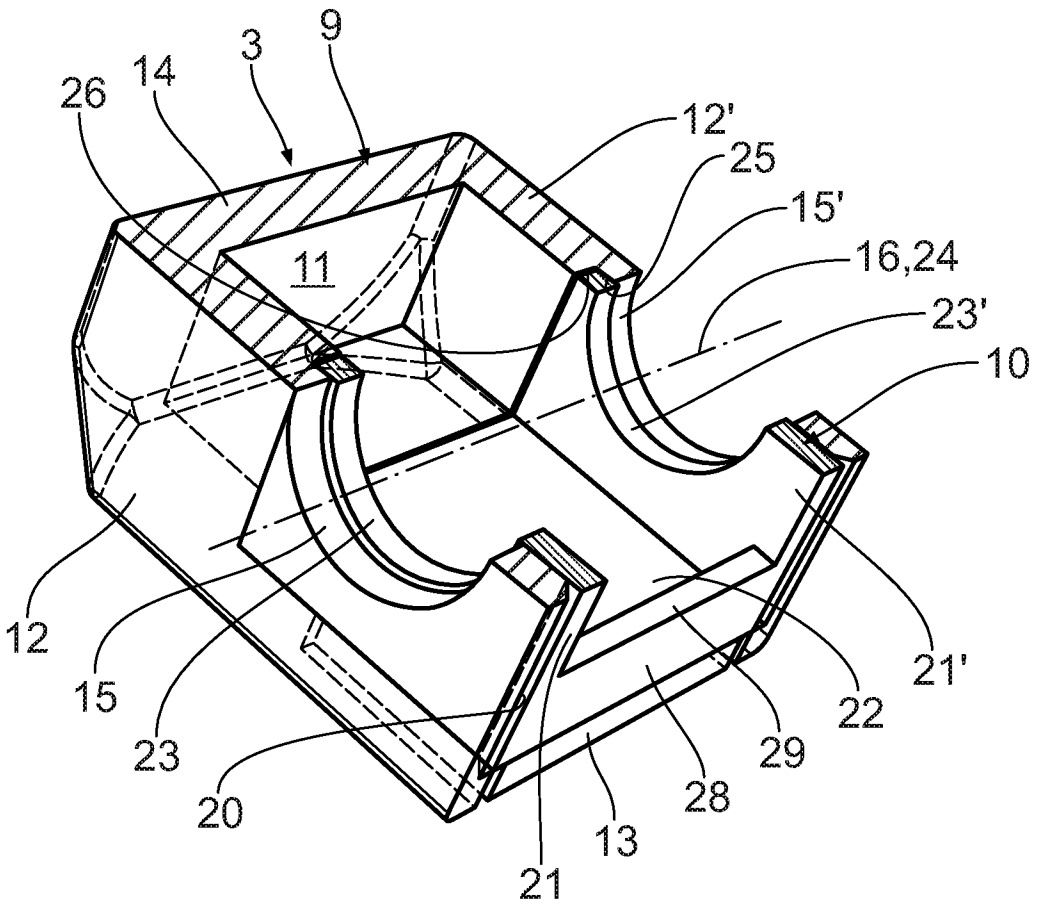
FIG. 5 is a first view of a housing of the subunit in FIG. 4.
Figure 6:
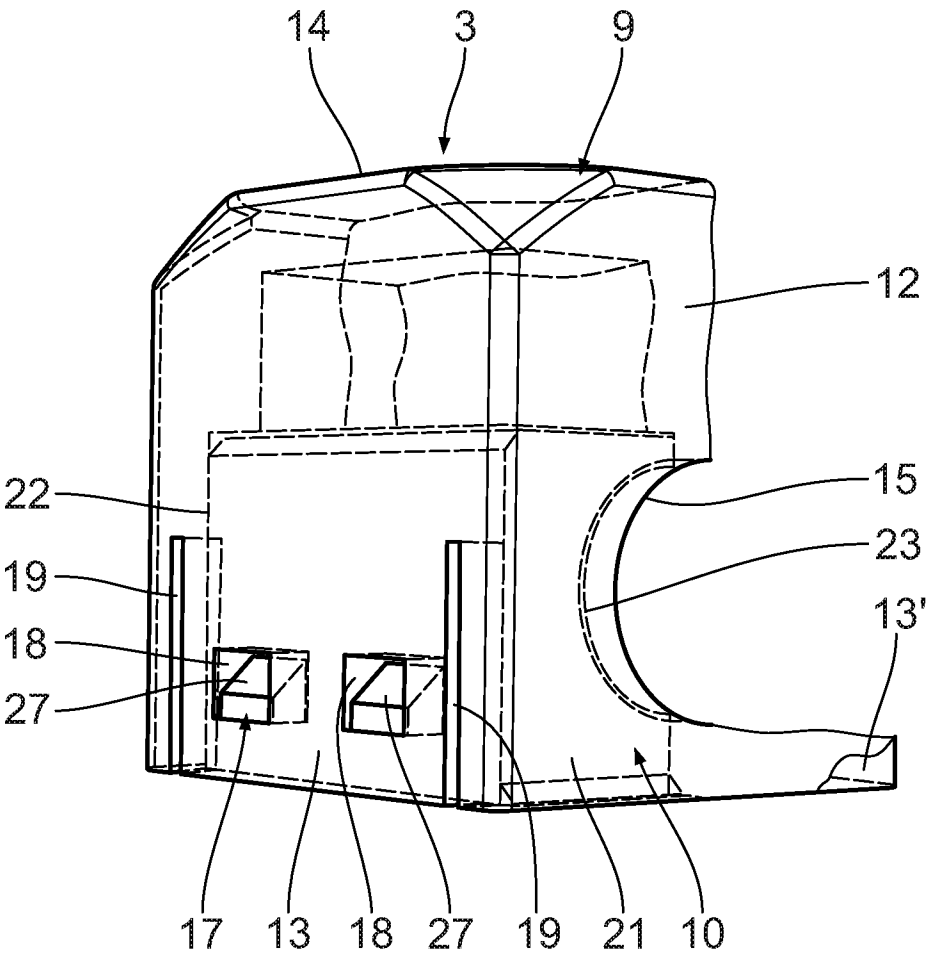
FIG. 6 is a second view of the housing of the subunit in FIG. 4.
Figure 7:
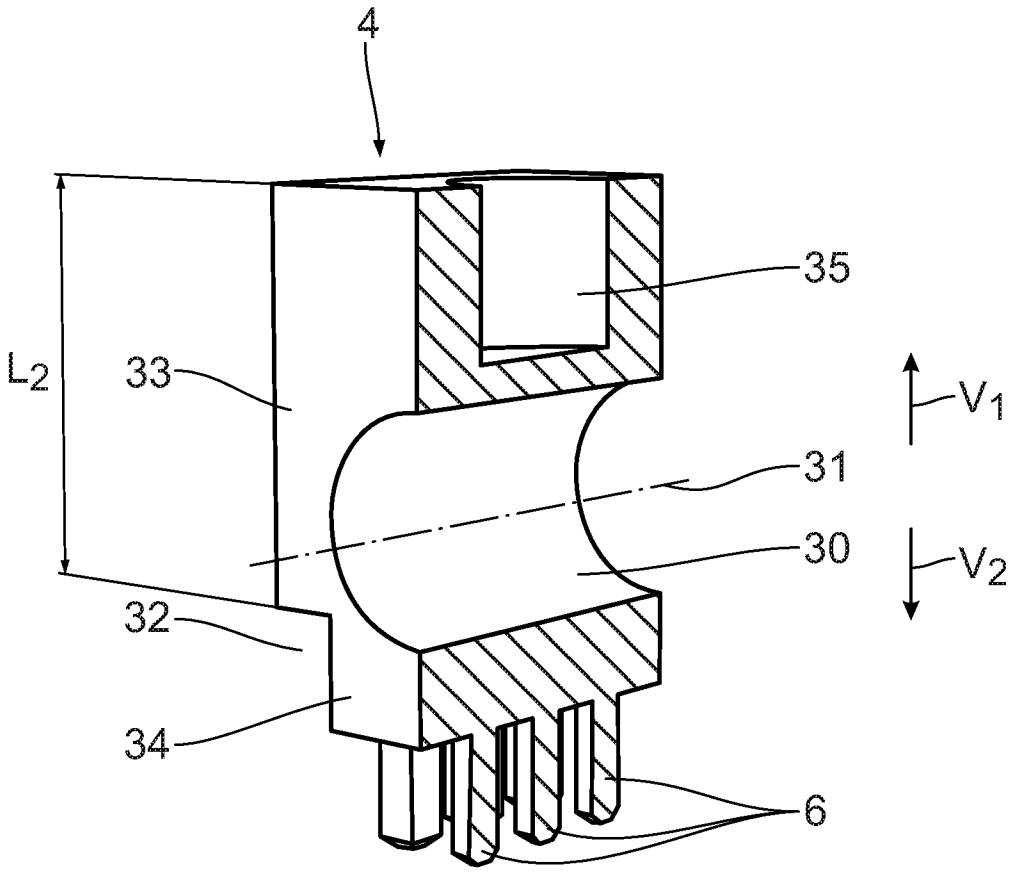
FIG. 7 is a view of a contact element with, arranged thereon, plug-in contact elements of the subunit in FIG. 4.

A first embodiment of the invention is described below with reference to FIGS. 1 to 7. A contacting device 1 includes a preassembled subunit 2 with a housing 3, with a first contact element 4, with a spring element 5 and with plug-in contact elements 6. The contacting device 1 further includes a second contact element 7 which is capable of being contacted with the first contact element 4 for the purpose of transmitting electrical energy to a circuit board 8.

The housing 3 exhibits two housing parts 9, 10 which delimit an interior space 11 at least in some regions. The first housing part 9 exhibits four side walls 12, 12', 13, 13' and an upper top wall 14, said side walls 12, 12' and also said side walls 13, 13' being situated opposite each other. In side walls 12, 12' associated openings 15, 15' have been formed which have a common first central longitudinal axis 16 and have been formed and arranged congruently in the direction of central longitudinal axis 16.

For the purpose of forming a latching connection 17 between the housing parts 9 and 10, in each instance two latching openings 18 have been formed in side walls 13, 13'. For the purpose of enhancing the flexibility of side walls 13, 13' in the region of the latching openings 18, a slot 19 has been formed in side walls 13, 13' between, in each instance, one of the latching openings 18 and the adjacent side wall 12, 12'. Side walls 12, 12', 13, 13' delimit opposite the top wall 14 an assembly opening 20 for inserting the second housing part 10.

The second housing part 10 includes four side walls 21, 21', 22, 22', of which side walls 21, 21' and side walls 22, 22' are situated opposite each other. Openings 23, 23' substantially corresponding to openings 15, 15' have been formed in side walls 21, 21'. Openings 23, 23' have a common second central longitudinal axis 24 which in the connected state of the housing parts 9, 10 overlaps with the first central longitudinal axis 16, so that openings 15, 23 and 15', 23' are substantially congruent. Side walls 12, 12', 13, 13' form on their inside an assembly recess 25 which, starting from the assembly opening 20, extends as far as a circumferential assembly stop 26. In the assembled state, the second housing part 10 bears against the assembly stop 26, and the openings 15, 23 and 15', 23' are aligned relative to one another. In the assembled state, side walls 21, 21', 22, 22' terminate flush with side walls 12, 12', 13, 13'.

For the purpose of forming the latching connection 17, latching projections 27 have been formed on an outside of side walls 22, 22', which in the assembled state of the housing parts 9, 10 engage in the associated latching openings 18. The assembly recess 25 has been adapted to a thickness of side walls 21, 21', 22, 22' in such a manner that the interior space 11 has a constant width in the direction of central longitudinal axes 16, 24 and perpendicular to central longitudinal axes 16, 24. A common wall thickness of side walls 12, 21 and 12', 21', respectively, and 13, 22 and 13', 22', respectively, is accordingly constant.

On a side facing away from the top wall 14, the second housing part 10 exhibits two boundary members 28, 28'. The boundary members 28, 28' are arranged on the respectively associated side wall 22, 22' and extend between side walls 21, 21'. The boundary members 28, 28' terminate flush with side walls 21, 21', 22, 22'. The boundary members 28, 28' and side walls 21, 21' delimit a passage opening 29.

The first contact element 4 is of cuboidal design. The first contact element 4 exhibits a receiving chamber 30 for the second contact element 7, which is of cylindrical design. The receiving chamber 30 takes the form of a through bore and has a central longitudinal axis 31.

The first contact element 4 is arranged in the interior space 11 in such a manner that the central longitudinal axes 16, 24 of the openings 15, 15', 23, 23' run parallel to central longitudinal axis 31, and the receiving chamber 30 is open with respect to the openings 15, 15', 23, 23'. The openings 15, 15', 23, 23' exhibit for this purpose a diameter $D_1$ that corresponds at least to a diameter $D_2$ of the receiving chamber 30. The first contact element 4 is displaceable linearly in the interior space 11 perpendicular to central longitudinal axis 31 and in the direction toward the passage opening 29. For this purpose, the first contact element 4 exhibits recesses 32 on a side facing toward the boundary members 28, 28', so that the first contact element 4 forms a guide portion 33, guided in the housing 3, and a passage portion 34 extending through the passage opening 29. A length $L_1$ of the interior space 11 from the top wall 14 as far as the boundary members 28, 28', is greater than a length $L_2$ of the guide portion 33, so that the first contact element 4 is displaceable perpendicular to central longitudinal axis 31, and the top wall 14 for the guide portion 33 forms a first stop $A_1$, for limiting the motion of the first contact element 4 in a first displacement direction $V_1$, and the boundary members 28, 28' form a second stop $A_2$ for limiting the motion of the guide portion 33 in a contrary second displacement direction $V_2$.

On the passage portion 34 the plug-in contact elements 6 are arranged in one piece, so that the plug-in contact elements 6 with the first contact element 4 are displaceable in the displacement directions $V_1$ and $V_2$.

On a side facing toward the top wall 14, the guide portion 33 exhibits a cavity 35 in the form of a blind hole, in which the spring element 5 is arranged. The spring element 5 bears in biased manner against the top wall 14 and the guide portion 33 and generates a spring force perpendicular to central longitudinal axis 31 in displacement direction $V_2$. The spring element 5 takes the form of a coil spring, for instance.

The plug-in contact elements 6 serve for mechanical and electrical connecting of the first contact element 4 to the circuit board 8. The plug-in contact elements take the form of pins, for instance. The plug-in contact elements 6 are capable of being plugged, in exactly fitting manner, into plug-in contact element receptacles which have been formed in the circuit board 8, as a result of which the mechanical and the electrical connections are established.

The second contact element 7 serves for contacting the first contact element 4. The second contact element 7 comprises an insertion portion 36, a first clamping portion 37, a contact portion 38, a second clamping portion 39 and a crimp portion 40. The contact portion 38 is of cylindrical design and corresponds in its length and its diameter to the receiving chamber 30, so that the contact portion 38 can be inserted in exactly fitting manner in the receiving chamber 30. The clamping portions 37, 39 are arranged on both sides of the contact portion 38. The clamping portions 37, 39 respectively include a circumferential groove 41, 41'. The respective groove 41, 41' tapers in the direction of a groove bottom and is, for instance, of triangular design in cross-section. The grooves 41, 41' are spaced in the direction of central longitudinal axis 31, corresponding to side walls 12, 21 and 12', 21', and exhibit peripherally an axial dimension that is at least equal to the axial dimension of side walls 12, 21 and 12', 21', so that the housing 3 is able to engage in the grooves 41, 41'.

For the purpose of inserting into the housing 3, the insertion portion 36 exhibits a tapering tip 42. The inserting of the second contact element 7 into the housing 3 is limited by an annular stop 43 which is formed by the crimp portion 40. For the purpose of contacting with a power supply line 44, the crimp portion 40 is of hollow cylindrical design at a free end and exhibits an insertion opening 45.

The housing 3 has been formed from a synthetic material. The contact elements 4, 7 and the plug-in contact elements 6 have been formed from a conductive material, for instance from brass. The crimp portion 40 has preferentially been soft-annealed.

The preassembly of the subunit 2 and the assembly of the contacting device 1 take place as follows:

The spring element 5 is arranged in the cavity 35 of the first contact element 4. Subsequently the first contact element 4 with the spring element 5 is inserted into the first housing part 9 until the spring element 5 bears against the top wall 14. Subsequently the second housing part 10 is connected to the first housing part 9. For this purpose, the plug-in contact elements 6 and the passage portion 34 are guided through the passage opening 29, so that the second housing part 10 is inserted into the assembly recess 25 of the first housing part 9. The second housing part 10 is moved in the direction of the top wall 14 until such time as it bears against the assembly stop 26 and the latching projections 27 latch in the latching openings 18. For the purpose of simple latching, side walls 13, 13' bend apart in the region of the slots 19 when the second housing part 10 is being inserted. In the latched state, the spring element 5 is biased and presses the first contact element 4 in displacement direction $V_2$ against the second stops $A_2$ which have been formed by the boundary members 28. Central longitudinal axis 31 has been displaced relative to central longitudinal axes 16, 24, so that the receiving chamber 30 is not oriented concentrically with respect to the openings 15, 23 and 15', 23'.

For the purpose of assembly of the contacting device 1, the second contact element 7 is connected to the power supply line 44 in electrically conducting manner. For this purpose, the power supply line 44 is inserted into the crimp portion 40 through the insertion opening 45 and is clamped there in electrically conducting manner by plastic deformation of the crimp portion 40.

The preassembled subunit 2 is connected to the circuit board 8 mechanically and in electrically conducting manner by means of the plug-in contact elements 6, by the plug-in contact elements 6 being inserted into associated plug-in contact element receptacles. Subsequently the housing 3 is displaced in displacement direction $V_1$ relative to the first contact element 4 and against the spring force of the spring element 5 in such a manner that central longitudinal axis 31 is substantially congruent with central longitudinal axes 16, 24, and the receiving chamber 30 is in alignment with the openings 15, 23 and 15', 23'. In this insertion state, the second contact element 7 is guided, beginning with the tip 42, through openings 15', 23', through the receiving chamber 30 and through openings 15, 23 until stop 43 strikes against side wall 13'. In this state, the second contact element 7 has been aligned relative to the first contact element 4 and the housing 3.

Subsequently the housing 3 is displaced in displacement direction $V_2$ relative to the first contact element 4 by means of the spring force of the spring element 5, as a result of which side walls 15, 23 engage in groove 41 and side walls 15', 23' engage in groove 41' and clamp the second contact element 7 in the receiving chamber 30 in the direction of central longitudinal axis 31 and also perpendicular to central longitudinal axis 31. In this clamping state, the spring element 5 presses the first contact element 4 against the contact portion 38, so that an electrical contacting between the first contact element 4 and the second contact element 7 takes place. By virtue of the firm connection of the first contact element 4 to the plug-in contact elements 6, consequently an effectively conductive electrical connection between the power supply line 44 and the circuit board 8 is achieved.

The disengaging of the electrical contacting between the first contact element 4 and the second contact element 7 takes place in reverse manner.

The contacting device 1 exhibits a small number of components and is consequently simply constructed and easy to assemble and preassemble. The electrical contacting has a low ohmic resistance and can be established and disengaged again in simple and reliable manner.

Figure 8:
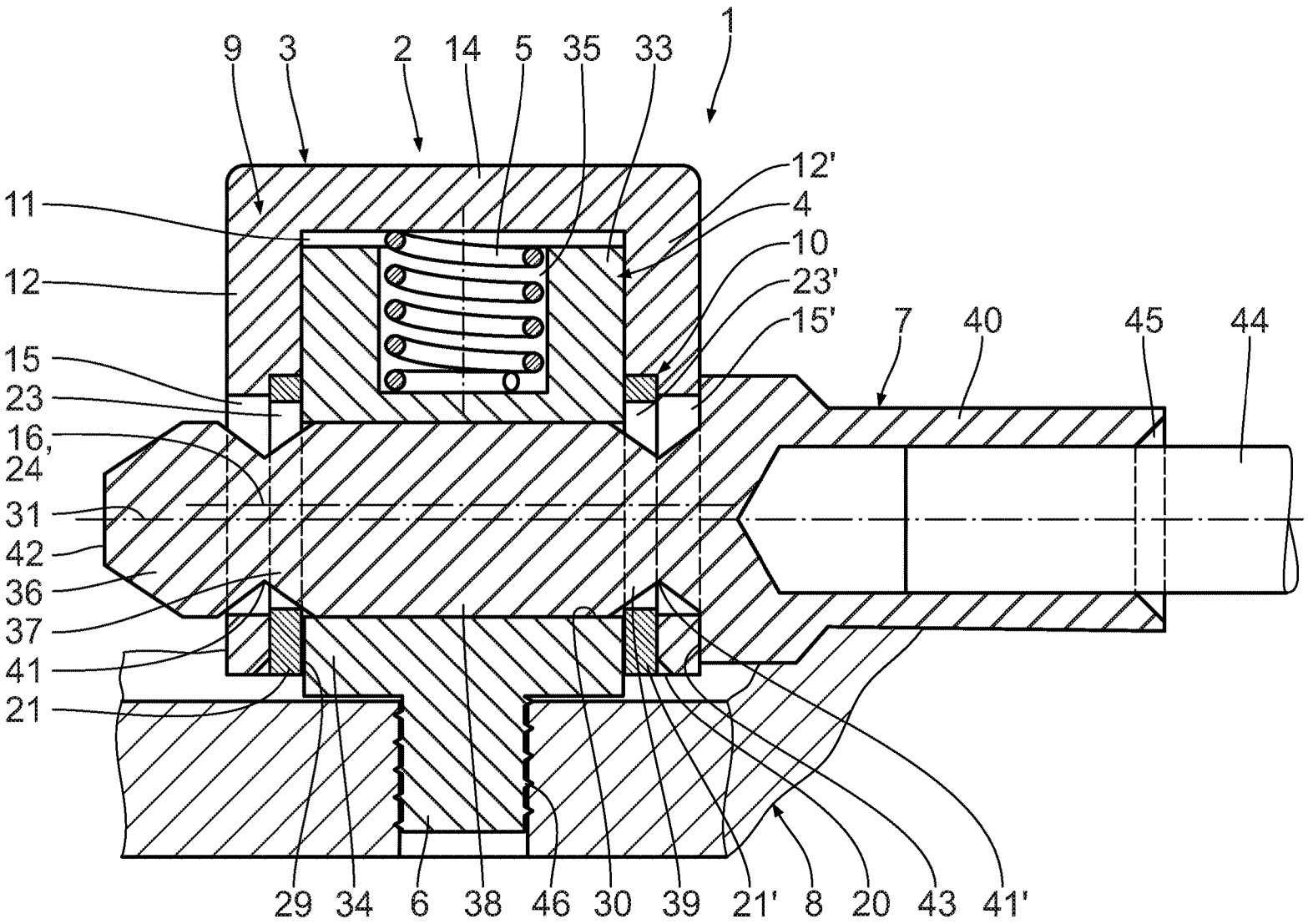
FIG. 8 is a sectional view of a contacting device for transmitting electrical energy from a power supply line to a circuit board, according to a second embodiment.

A second embodiment of the invention is described below with reference to FIG. 8. In contrast to the preceding embodiment, the contacting device 1 exhibits precisely one plug-in contact element 6. The plug-in contact element 6 takes the form of a threaded pin and exhibits an external thread 46. By virtue of a rotary motion, the plug-in contact element 6 is inserted or plugged into an associated plug-in contact element receptacle of the circuit board 8. For this purpose, the plug-in contact element receptacle exhibits a corresponding internal thread. With regard to the further structure and the further mode of operation of the contacting device 1, reference is made to the preceding embodiment.

Figure 9:
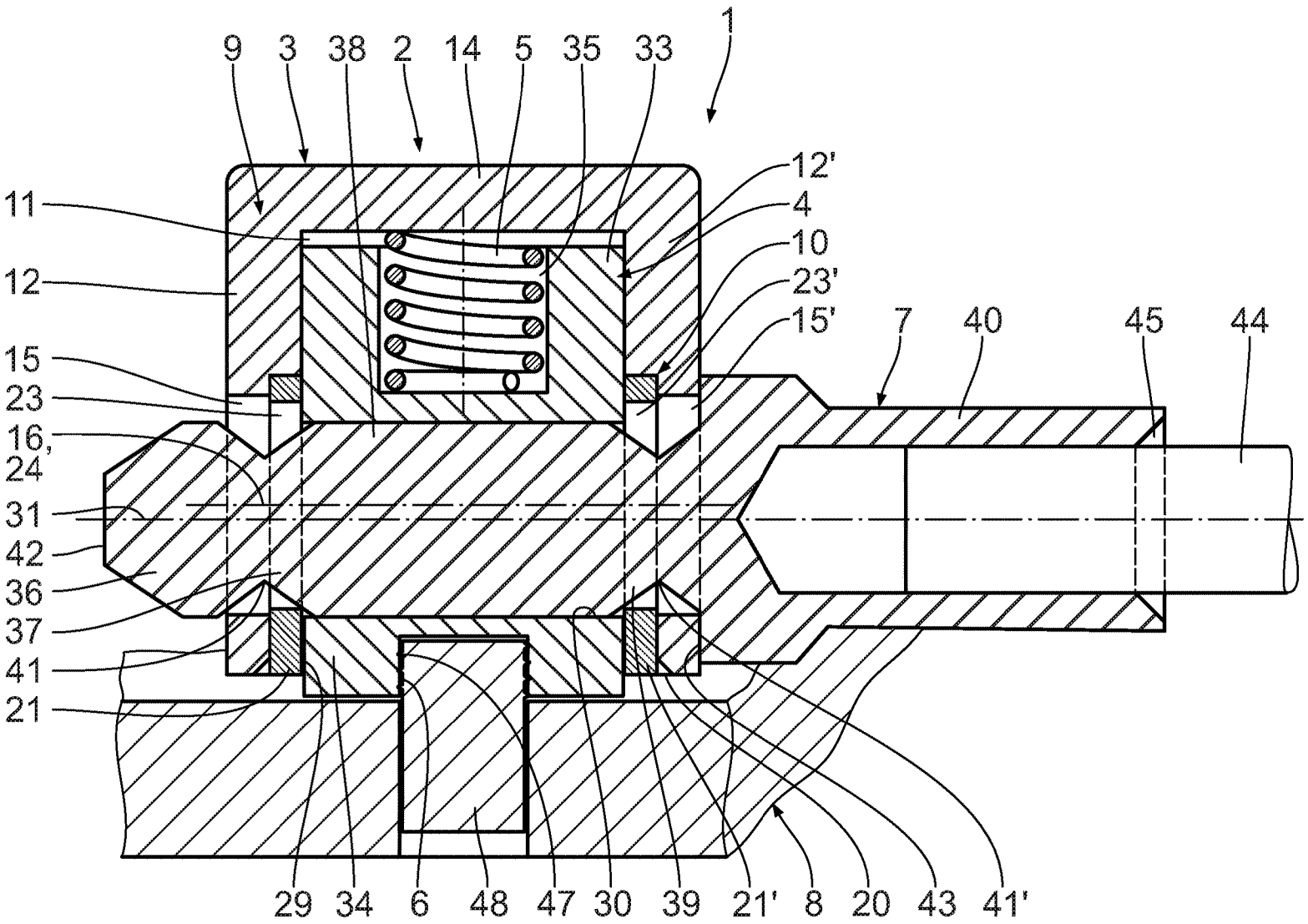
FIG. 9 is a sectional view of a contacting device for transmitting electrical energy from a power supply line to a circuit board, according to a third embodiment.

A third embodiment of the invention is described below with reference to FIG. 9. In contrast to the preceding embodiments, the plug-in contact element 6 takes the form of a threaded bore or threaded recess. The plug-in contact element 6 exhibits an internal thread 47. By virtue of a rotary motion, the plug-in contact element 6 is plugged or screwed onto a threaded pin 48 of the circuit board. The threaded pin 48 of the circuit board is connected to the circuit board 8 in conducting manner. The threaded pin 48 of the circuit board serves as plug-in contact element receptacle on which the plug-in contact element 6 is received. With regard to the further structure and the further mode of operation of the contacting device 1, reference is made to the preceding embodiments.

While specific embodiments of the invention have been shown and described in detail to illustrate the application of the principles of the invention, it will be understood that the invention may be embodied otherwise without departing from such principles.

The invention claimed is:

1. A contacting device for transmitting electrical energy to a circuit board, the contacting device comprising:

a housing comprising at least one opening;

a first contact element arranged in the housing and the first contact element comprising a receiving chamber which is open with respect to the at least one opening, the receiving chamber having a central longitudinal axis;

at least one plug-in contact element for mechanically and electrically connecting the first contact element to a circuit board;

a second contact element for insertion into the receiving chamber through the at least one opening and for contacting the first contact element, the housing and the first contact element being displaceable relative to one another in a direction transverse to the central longitudinal axis, wherein a spring element acting in a direction transverse to the central longitudinal axis is arranged between the housing and the first contact element, the at least one plug-in contact element and the first contact element being firmly connected to one another, wherein in an insertion position, the first contact element is displaced relative to the housing by an external force against a spring force of the spring element in such a manner that the second contact element is insertible into the receiving chamber of the first contact element through the at least one opening of the housing, wherein the first contact element is configured to be transferred relative to the housing by relaxation of the spring element into a clamping position, wherein in the clamping position, the second contact element is contacted with the first contact element between the first contact element and the housing by the spring force of the spring element acting in the direction transverse to the central longitudinal axis.

2. The contacting device as claimed in claim 1, wherein the first contact element and the at least one plug-in contact element are formed in one piece.

3. The contacting device as claimed in claim 1, wherein the housing forms a first stop for limiting motion of the first contact element in a first displacement direction and a second stop for limiting motion of the first contact element in a contrary second displacement direction.

4. The contacting device as claimed in claim 1, wherein the housing has a passage opening for the first contact element.

5. The contacting device as claimed in claim 1, wherein the housing comprises two housing parts.

6. The contacting device as claimed in claim 1, further comprising at least another plug-in contact element to form at least a plurality of plug-in contact elements for distributing energy, the plurality of plug-in contact elements being firmly connected to the first contact element.

7. The contacting device as claimed in claim 1, wherein the second contact element has a cylindrical contact portion, and the receiving chamber for receiving and clamping the contact portion is cylindrical.

8. The contacting device as claimed in claim 1, wherein the second contact element has at least one groove, and the housing forms a wall for engagement in the at least one groove, the wall defining at least a portion of the at least one opening.

9. The contacting device as claimed in claim 1, wherein the housing has another opening to provide at least two openings, the two openings being situated opposite one another for passing through the second contact element.

10. The contacting device as claimed in claim 1, wherein the second contact element has a stop for limiting insertion of the second contact element into the housing.

11. The contacting device as claimed in claim 1, wherein the second contact element has a tapering tip for inserting into the housing.

12. The contacting device as claimed in claim 1, wherein the second contact element has a crimp portion for connecting to a power supply line.

13. A method for assembling a contacting device, the method comprising the following steps:

providing a preassembled subunit comprising a housing, a first contact element, a spring element and at least one plug-in contact element for mechanically and electrically connecting the first contact element to a circuit board, the housing comprising at least one opening, the first contact element being arranged in the housing and the first contact element comprising a receiving chamber which is open with respect to the at least one opening, the receiving chamber comprising a central longitudinal axis, the housing and the first contact element being displaceable to one another in a direction transverse to the central longitudinal axis, the spring element acting in a direction transverse to the central longitudinal axis, the spring element being arranged between the housing and the first contact element, the at least one plug-in contact element and the first contact element being firmly connected to one another;

contacting the first contact element with the circuit board by inserting the at least one plug-in contact element into an associated plug-in contact element receptacle of the circuit board;

displacing the housing and the first contact element relative to one another in a direction transverse to the central longitudinal axis against a spring force of the spring element into an insertion position;

inserting a second contact element into the receiving chamber through the at least one opening;

displacing the housing and the first contact element relative to one another in a direction transverse to the central longitudinal axis by relaxation of the spring element into a clamping position;

clamping the second contact element located in the receiving chamber between the housing and the first contact element such that the second contact element is contacted with the circuit board in an electrically conducting manner via the first contact element and the at least one plug-in contact element.

14. The contacting device as claimed in claim 5, wherein the two housing parts form a latching connection.

15. A contacting device for transmitting electrical energy to a circuit board, the contacting device comprising:

a housing comprising at least one opening;

a first contact element arranged in the housing and the first contact element comprising a receiving chamber which is open with respect to the at least one opening, the receiving chamber having a central longitudinal axis;

at least one plug-in contact element for mechanically and electrically connecting the first contact element to a circuit board;

a second contact element for insertion into the receiving chamber through the at least one opening and for contacting the first contact element, the housing and the first contact element being displaceable relative to one another in a direction transverse to the central longitudinal axis;

a spring element in contact with the housing and the first contact element, the at least one plug-in contact element and the first contact element being connected to one another, the housing and the spring element being displaceable in a direction transverse to the central longitudinal axis, wherein a position of the receiving chamber of the first contact element is adjustable relative to the at least one opening of the housing based a compression state of the spring element.

16. The contacting device as claimed in claim 15, wherein the spring element comprises a compressed state and a relaxed state, the first contact element comprising an insertion position and a clamping position, the spring element being in the compressed state when the first contact element is in the insertion position, the second contact element being insertable into the receiving chamber when the first contact element is in the insertion position, the first contact element being in contact with the second contact element and the spring element being in the relaxed state when the first contact element is the clamping position.

17. The contacting device as claimed in claim 15, wherein the first contact element comprises a first contact element cavity, at least a portion of the spring element being arranged in the contact element cavity.

18. The contacting device as claimed in claim 15, wherein in an insertion position, the first contact element is displaced relative to the housing by an external force against a spring force of the spring element such that the second contact element is insertable into the receiving chamber of the first contact element through the at least one opening of the housing, wherein the first contact element is movable relative to the housing by relaxation of the spring element into a clamping position, wherein in the clamping position, the second contact element is in contact with the first contact element between the first contact element and the housing by the spring force of the spring element acting in the direction transverse to the central longitudinal axis.

19. The contacting device as claimed in claim 15, wherein the first contact element is electrically connected to the circuit board when the first contact element is in the clamping position.

20. The contacting device as claimed in claim 15, wherein the housing comprises a first stop for limiting motion of the first contact element in a first displacement direction and a second stop for limiting motion of the first contact element in a contrary second displacement direction.

* * * * *